US011167165B2

(12) United States Patent
Publicover

(10) Patent No.: US 11,167,165 B2
(45) Date of Patent: Nov. 9, 2021

(54) CONNECTOR FOR REBOUNDING APPARATUS

(71) Applicant: JumpSport, Inc., Saratoga, CA (US)

(72) Inventor: Mark W. Publicover, Saratoga, CA (US)

(73) Assignee: JumpSport, Inc., Saratoga, CA (US)

( * ) Notice: Subject to any disclaimer, the term of this patent is extended or adjusted under 35 U.S.C. 154(b) by 50 days.

(21) Appl. No.: 16/508,243

(22) Filed: Jul. 10, 2019

(65) Prior Publication Data

US 2020/0023224 A1 Jan. 23, 2020

Related U.S. Application Data

(63) Continuation of application No. 16/397,726, filed on Apr. 29, 2019, now abandoned, which is a continuation of application No. PCT/US2017/059412, filed on Oct. 31, 2017.

(60) Provisional application No. 62/415,451, filed on Oct. 31, 2016.

(51) Int. Cl.

| | |
|---|---|
| ***A63B 21/055*** | (2006.01) |
| ***A63B 5/11*** | (2006.01) |
| ***A63B 21/04*** | (2006.01) |

(52) U.S. Cl.

CPC ..... *A63B 21/0557* (2013.01); *A63B 5/11* (2013.01); *A63B 21/0428* (2013.01)

(58) Field of Classification Search

CPC .. A63B 5/11; A63B 5/08; A63B 21/02; A63B 21/0428; A63B 21/0557; A63B 21/0552; A63B 21/154; A63B 71/0054; A63B 2005/085; A63B 6/00; A63B 6/02; A63B 6/025; Y10T 24/314; B65D 63/109; F16L 3/233

See application file for complete search history.

(56) References Cited

U.S. PATENT DOCUMENTS

| | | | | |
|---|---|---|---|---|
| 8,038,580 | B2 * | 10/2011 | Pieper Genannt Schmauck | A63B 5/11 482/27 |
| 9,289,637 | B2 * | 3/2016 | Publicover | A63B 5/11 |
| 10,307,628 | B2 * | 6/2019 | Tseng | A63B 5/11 |
| 10,532,238 | B2 * | 1/2020 | Publicover | A63B 5/11 |
| 2013/0316876 | A1 | 12/2013 | Publicover et al. | |
| 2016/0096056 | A1 | 4/2016 | de Boer | |

FOREIGN PATENT DOCUMENTS

| | | |
|---|---|---|
| DE | 202007019487 | 11/2012 |

OTHER PUBLICATIONS

International Search Report and Written Opinion, dated Feb. 27, 2018, from PCT Application No. PCT/US2017/059412, 8 pages.

* cited by examiner

*Primary Examiner* — Megan Anderson
(74) *Attorney, Agent, or Firm* — Klarquist Sparkman, LLP

(57) ABSTRACT

A trampoline with a frame has a rebounding mat that is tensioned to the frame with a plurality of flexible and cordlike linear elastic members. Cordlike elastic members are connected to the frame with at least one connector retaining the cord such that two portions of the cord extend at an angle greater than 5 degrees and less than 25 degrees relative to one another.

19 Claims, 12 Drawing Sheets

CONNECTOR FOR REBOUNDING APPARATUS

CROSS REFERENCE TO RELATED APPLICATIONS

This application is a continuation of U.S. patent application Ser. No. 16/397,726, filed Apr. 29, 2019, which is a continuation of International Application No. PCT/US2017/059412, filed Oct. 31, 2017, which was published in English under PCT Article 21(2), which in turn claims the benefit of U.S. Provisional Application No. 62/415,451, filed Oct. 31, 2016. The provisional application is incorporated herein in its entirety.

BACKGROUND

This disclosure relates to rebounding apparatus that is of any size. The described apparatus may also be fabricated with diverse and assorted materials, such as plastics of various types, fiberglass, Kevlar or other aramid fibers may be used, or other composites of a suitable material, or some combination of any of these materials capable of providing sufficient structural support for a trampoline and its typical usage and to support the stresses placed upon it. The adult and adult sized users of such devices are individual persons generally over 16 years old, and between a height of 4 feet 7 inches and 6 feet 7 inches, with a weight range between 70 lbs. to 400 lbs. Children between the ages of 4 to 8 may also use these trampolines for fitness and fun, but their bodyweight is generally lighter, between 30 to 80 lbs. Young people between the ages of 8 and 16 can vary greatly in weight and size, from 50 lbs. to in excess of 300 lbs. The disclosed device is configurable to support each of individuals in these weight ranges and within these age groups.

Smaller rebounders such as fitness rebounders and trampolines, have a bed that is made of flexible fabric attached to an encompassing or closed frame by spring elements or by one or more cordlike flexible elastic members (cords, bungees, or the like). A plurality of legs supports the frame at a distance above the ground. The height of the rebounding surface above the ground surface can range from a few inches to approximately 18 inches. The height may be greater, but generally not higher than 24 inches above the ground surface for a fitness sized trampoline encompassing an area of approximately 2,000 square inches or less. Any higher than 24 inches, and safety concerns are raised as a user would be higher off the ground surface on a smaller platform (jump surface) that is unstable. Hence, a device higher than 24 inches above the ground surface generally needs to be of a greater diameter than what's been described, and tends towards being more properly defined as a large trampoline or full size trampoline, and not a fitness rebounder or mini trampoline. The height off the ground surface for larger trampoline may be 36 inches or greater in limited situations. The disclosed device and its utility in not limited in anyway by the height of the trampoline surface to which it is attached or coupled. Additionally, it should be noted that the disclosed devices are not limited to mini-trampolines under 2000 square inches as the disclosed device may also be adapted to larger, full sized trampolines with a diameter extending to 20 feet.

The spring members or elements may be of any kind of rope or cord which has elastic qualities which permits the spring member to stretch when extended or compress when extension is reversed or shortened. The spring members may be any type of elastic cords or may be made of a natural or synthetic rubber or other man made elastic material, or include the type of cords known as bungee or shock cords composed of one or more elastic strands forming a core and commonly covered in a sheath of woven material such as cotton, polypropylene, polyester or other suitable material. Also, the spring member may include any other types of metal or composite springs or other type of cords that may function with the indicated embodiments or that may be configured for use with a rebounder described herein.

In a typical prior art trampoline and rebounder configuration, the mat is tensioned by such previously described elastic or spring elements generally arranged radially between the mat outer diameter and the inner diameter of the frame. This area is sometimes covered by a static pad which is attached to the frame, and prevents the user from stepping directly onto the elastic elements or springs. The disclosed devices allow for the spring members to have the tension adjusted according to a user's weight or athletic ability but in a connector with a smaller size and lower profile; and without the need to replace the spring member. It is an object of the disclosed device to reduce the stress and friction placed on the coupled spring members in order to increase they useful life by reorienting the cord coupling path and direction in a new and innovative way. In the past, the only way tension has been changed or adjusted for mini-trampoline spring members, especially elastic cords, has been to remove an existing cord, and then replace it with an entirely different elastic cord member of a different tension; generally achieved by the replacing cord being of a lesser or greater diameter. These requirements and limitations are substantially reduced with the current disclosed devices because the same cord is used to change the tension for multiple users. With the current device, the user may adjust the existing cord to alter tension, resulting in a significant gain in utility, as well as reduction in costs and expenses. Additionally, users of different weights and abilities may use the same trampoline and cord members even though they vary greatly in body weight, or athletic ability.

Disclosed herein are trampoline-type devices that comprise an encompassing frame supported by plural legs that contains adjustable bungee (or elastic member, or elastic spring or cord member), connectors and extenders.

Disclosed is an improved connector that angles cord attachment locations (or channels) to successfully minimize cord wear and helps to retain the seated or attached cord in order to reduce the chance of detachment of the cord from the connector when under rebounding stress. The result is longer cord life and better cord retention in the connector.

The angles are defined as Gamma and/or Beta. The angle β (Beta) angle is defined as the angle formed between the top and bottom portions of the elastic spring member (cord, or bungee) when they are installed on a trampoline at rest. The angle Γ (Gamma) is defined as the angle formed between the upper connector spring member receiving channel and the lower spring member receiving channel, which is substantially the same as the Beta angle as it extends towards the enclosing frame. The relative angles will vary depending on the distance of the connector to the frame, and depending on the diameter or thickness of the frame rail. The result is a trampoline elastic cord connector that has the upper and lower receiving portions angled apart to substantially follow or match the angle of Γ at the connector and the angle β of an elastic cord when it is installed on the trampoline. This matching angle results in a smooth connection to the cord along the path of the connector cord receiving channels (angle Γ) which greatly reducing the stress placed upon the cord member as it extends from the connector toward the frame (angle β).

Also disclosed is a cord and elastic spring member connector which permits an increase in the usable surface area of the rebounding mat without a corresponding loss or reduction of elastic spring member length.

Also disclosed is a connector that achieves a lower vertical profile which in turn, reduces the chance that the connector will interfere with a user jumping on the device by reducing the chance of a user's footfall impediment by said connector. This is achieved in part by removing the need for material separation of the cord portions from each other at the connector. This is not a usual solution. Generally, it is the goal to eliminate contact of any kind between portions of the elastic cord segments. The motive to remove or minimize friction inevitably points in the direction of solutions that naturally keep such cord portions separate from each other. Keeping cord segments from contacting each other reduces the chance of unwanted friction, and the resultant wear and tear that can occur to the elastic cord segments. In direct contrast, the instant connector design actually permits cord segments to be in contact with each other.

The challenge with lowering the top portion of the connector is that one must then raise the lower receiving channel at the same time. If one were to lower only the top relative to the mat strap bar and leave the lower receiving portion in the same place, it results in a twisting moment or torque which rotates the connector upward. Even though it appears to successfully appear to have a lower profile when viewed from the side and at rest, the connector rotates when installed such that it will protrude up even higher than before. This effect can be even more pronounced when the rebounder is being engaged by a user.

Another improvement for balancing the connector in the way shown is it does not matter where the terminal ends of the cord member portions are located; it only matters which direction the cord member portions extend away from the connector. This is what led the inventor and engineers to develop these designs where, when knots are used in some embodiments, the knots can mount low and out of the way, and then the cord member is routed up a guide hump; and then allowed to extend out to the frame. The closer the top elastic member loop is to the bottom legs, the lower the profile can be. It should be apparent that the upper channel and lower channel may each receive a portion of the elastic member along a curved surface facing the interior of the jumping mat; or they may differ in that one portion possesses a curved receiving portion and the opposing receiving portion is comprised of two bores or openings capable of receiving terminal cord ends, when the elastic member comprises a cord segment with two terminal ends. In some cases, the ends may have a knot or a bulbous protrusion preventing the cord end from slipping out of the holes when the cord is installed on the connector. In each case the opposing channels (or holes) are angled in the manner described in this specification.

Also disclosed is another innovative design improvement that practically eliminates the material separating the top and bottom loop on several of the designs. Since it was learned that the closer one can get the top and bottom, the lower profile would result, such that the new design eliminated any separation. This was not a logical direction to go from a design perspective because one would think that having the cords in regular frictional contact would result in a shortened cord life. It turns out that when the cords touch near the top loop, there is little damaging motion at that part of the cord, so the durability of the cord remained good due to the general lack of relative motion, or a "sawing back and forth" effect, at the frictional contact location. In fact, some connectors tested such as that shown at 301 and 401, had a longer cord life than even the company's current connector, because other improvements were added that helped the cord life more than the frictional contact of the cords decreased life. These added improvements made were in aligning the cord guides on the connectors where the cord was actually going to go or directionally extend. With current connectors, the connector's cord receiving portions point straight ahead and are parallel with each other. In reality, the top of the elastic cord angles up to go over the frame and the bottom of the elastic cord angles down to go under the frame. By providing smooth surfaces leading to these angles instead of square corners, elastic cord life was increased.

Because of elastic cords complete flexibility and ability to extend and stretch, it has never been previously considered that altering connector angles would provide any sort of improvement to cord longevity and function, and so the improvements with this solution are significant, in that the new connector allows for both a reduced vertical profile and a slightly larger jump surface, without loss in spring performance because the original spring length does not need to be altered; i.e. made shorter which would adversely affect bounce performance. And, because the cord segments are permitted to touch each other, less material of the connector is required to be disposed between them. Traditionally, to separate cord segments, one must physically do so by thickening the amount of material between them in order to create the space required to keep them separate; especially during jumping or use while the spring members are being extended downward. Intentionally permitting cord contact at the described points is unique in that the goal has always been to reduce or remove frictional contact at any point for cord segments in relation to each other. All connector prior to the disclosed device possessed receiving channels that were parallel to each other and did not diverge at an angle relative to each other. This results in a bend or pinch at the location where the spring member leaves the channel. The cords go from substantially parallel to each other, to an angle relative to each other in order to wrap around the frame rail of a rebounder. Thus the cord segments are frictionally pinched and bent the moment they extend from the connector. The disclosed device reduces such frictional contact such that cord life has been found to increase approximately 28%; a significant improvement over prior art.

The result of these various improvement is to create a lightweight connector with less overall structural material that has traditionally been needed to separate cord members that are situated substantially above and below each other when disposed on the trampoline frame and mat. Most of the removed material is what is commonly filled in between these upper and lower cord segments. As a result, the instant connector is less thick in height, taking up less vertical space and so produces a lower profile connection between the spring members and the mat jump surface. Finally, the structural material of the connector can be entirely removed (FIG. 2 for example) such that only one receiving channel exists. In such cases, the Gamma angle represents the angle of the upper inside portion of the receiving channel, and the opposing inside portion (or lower portion) of the channel, even though the cord portions may be in frictional contact with each other, without a separating barrier between them. The Gamma angle should still match the Beta angle of the cord portions as they extend towards the frame.

SUMMARY

In the present invention, the first object is achieved by providing a rebounding surface comprising a closed frame that is horizontally disposed, a rebounding mat having at least a central portion thereof elastically suspended within said closed frame, at least one cordlike flexible elastic member, a plurality of connectors attached to the perimeter of the central portion of the rebounding mat, connector member connecting a cordlike flexible elastic member to the rebounding mat, wherein at least one of the connectors has an upper cordlike flexible elastic member (cord, bungee, spring member) receiving channel and a lower cordlike flexible elastic member receiving channel, and where the Gamma, angle between the upper receiving channel and the lower receiving channel is greater than 0 degrees. The angle gamma has also optimally been found between 5 and 25 degrees. It has also been determined that the disclosed device of FIG. 9 has a gamma angle more optimally between 9 and 15 degrees. But, it should be noted that any angle greater than zero is new as to spring member receiving portions of the connector and is thus an improvement over prior art. The effect is even more pronounced where the Gamma angle is between 5 and 25 degrees. The prior description may also be applied to the angle Beta.

Also disclosed is the same Gamma and Beta angles applied to a connector able to receive an elastic cord member having a first end and an opposing end for coupling the central portion of said rebounding mat in elastic suspension to said frame, a plurality of the disclosed connectors attached to the perimeter of the central portion of said rebounding mat, each connector connecting a cordlike flexible elastic member to the rebounding mat, wherein at least one of the frame, and at least one cordlike elastic member and a connector of said plurality are adapted to dispose at least one of the first end and opposing end of the at least one cordlike elastic member at least two alternative positions to provide at least two alternative levels of tension to the rebounding mat.

Another way of describing the adjustability of the spring members is that at least one of the connectors couples a cordlike elastic member in a manner such that the tension of the "tensioned portion" of the elastic member can be adjusted by moving a portion of the body of the member relative to the connector. The "tensioned portion" is defined as that portion of the elastic member that extends between the two most distant places where the cord is connected where the tensioned part of the cord member terminates. It can be possible for parts of the cord to extend beyond the tensioned part.

As one example, if an elastic member or bungee were to be knotted, the excess material would be part of the cord, but not part of the tensioned portion of the cord. This is shown in FIGS. 1D, 106 and 108. 106 and 108 represent the *nexus* between the tensioned and non-tensioned portion of the cordlike elastic member. The knot of the cord and some additional cord material are part of the same cord but are not under tension.

An additional aspect of the invention is characterized in that the described connector, clip, or coupler (interchangeable descriptors) is comprised of no less than three connection location points or positions for retaining an elastic cord member that is capable of multiple tension adjustment positions. One attachment (or mated engagement) position occurs where one segment or length of the cord is directly adjacent and seated such that it fastens or holds along a curve segment of the connector whose angle_is always greater than 180 degrees; preferably at or greater than 200 degrees. Note that "mated engagement" can also refer to a cord segment or bulbous portion being attached or inserted in or to an aperture at a 90-degree angle in the aperture. However, this angle can be greater than 90 degrees. It has been found that 200 degrees optimally minimizes unwanted cord friction along the curved attachment position where the angle $\alpha$ is always greater than 180 degrees for the curvilinear surface shown on the connector. This cord loop attachment position or retaining feature holds a central segment of the elastic cord at some location between two additional attachment positions. The second and third attachment positions consist of apertures, apertures or sockets (which are interchangeable terms) that retain the two ends of the elastic cord. Sometimes additional material of the elastic spring member may be present at a distance further from an attachment aperture than the bulbous protrusion secured at an aperture location on a connector, or elsewhere. For example, the cord may be knotted such that the terminal end of the cord is not part of the knot, but rather constitutes nonfunctioning excess material. This is defined as the tensioned portion of the cord segment, which is next to 1D, 106 and 108. The attachable ends of the bungee or elastic cords are of a larger diameter than the apertures or sockets such that they will not slip back through the apertures. These attachable ends may be configured to do this any number of ways; however, one preferred method is to knot the cord at or near the end, and at one or more additional locations along the length of the elastic cord so that multiple tension adjustments may be achieved. The remainder of the same cord encircles the frame rail opposite the connector and then returns to be connected at a third tensioned position, which is that portion of the elastic member that is furthest from where the first tensioned coupling occurs. So the elastic cord extends between the two most distant tensioned locations where the cord is connected. Other ways of ensuring that the coupled or connected ends of the cords are larger than the diameter of the cords themselves may be conceived, some of which are disclosed herein. Knots are a preferred method due to the simplicity and ease of adjustability. Of no less importance is the advantage of knots taking up very little space when compared to other attachments that serve to enlarge the end of a cord member.

Another aspect of the invention is characterized in that the rebounding surface further comprises a plurality of cord like elastic members, wherein at least some of said plurality of cord like elastic member are folded at the center thereof, with the folded center thereof wrapped around the connector and each of the two portion thereof between the center and the first and opposing end returning to wraparound an adjacent portion of the frame such that the first and opposing ends are tensioned on return to connect at the periphery of the rebounding mat to provide tension thereto.

The above and other objects, effects, features, and advantages of the present invention will become more apparent from the following description of the embodiments thereof taken in conjunction with the accompanying drawings.

DETAILED DESCRIPTION

Figure 1A:
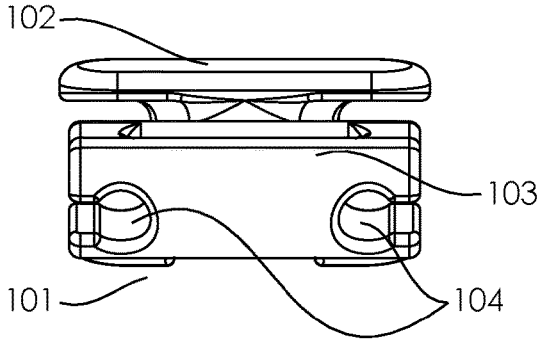
FIG. 1A is a rear view of an outside curled connector.
Figure 1B:
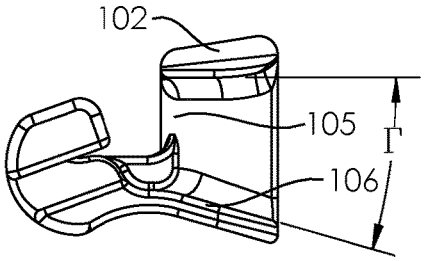
FIG. 1B is a side view of an outside curled connector.
Figure 1C:
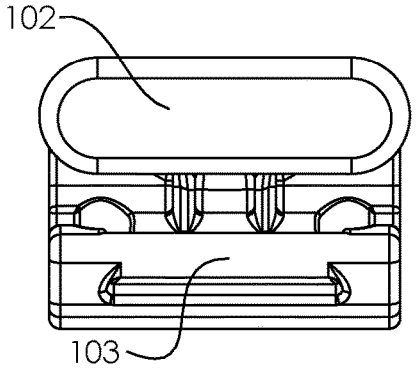
FIG. 1C is a top view of an outside curled connector.
Figure 1D:
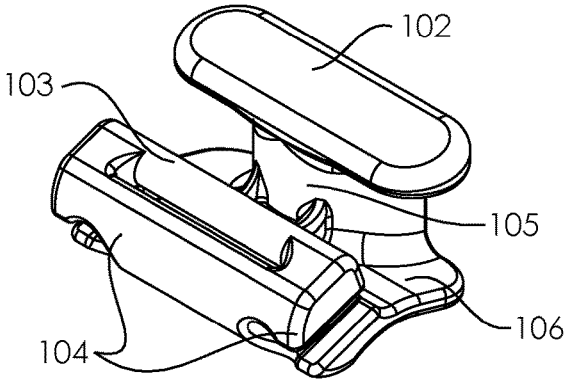
FIG. 1D is a rear isometric view of an outside curled connector.
Figure 1E:
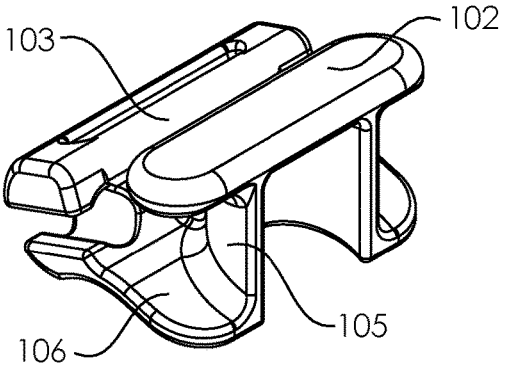
FIG. 1E is an upper front isometric view of an outside curled connector.
Figure 1F:
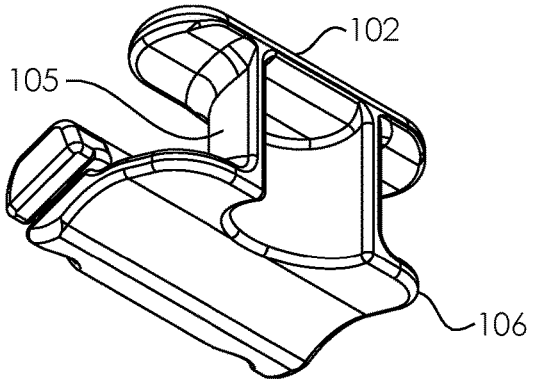
FIG. 1F is a lower front isometric view of an outside curled connector.

FIG. 1A is a rear view of an outside curled connector, 101. It is comprised of a top, 102, a mat strap bar, 103, and elastic member knot holes, 104. FIG. 1B is a side view of an outside curled connector, 101. This view shows the loop contact surface, 105, and the bottom cord guide, 106. The angle Gamma, Γ defines the angle between the under-surface of the top 102 and the surface of the bottom cord guide 106. FIG. 1C is a top view of an outside curled connector. FIG. 1D is a rear isometric view of an outside curled connector, 101. FIG. 1E is an upper front isometric view of an outside curled connector. FIG. 1F is a lower front isometric view of an outside curled connector.

Figure 2A:
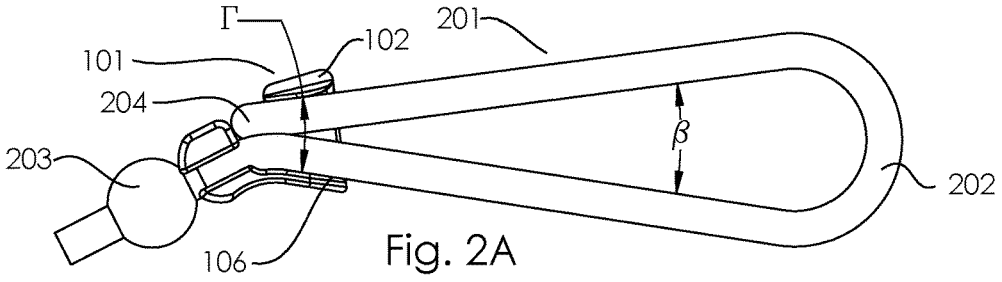
FIG. 2A is a side view of an outside curled connector with an elastic member cord installed.

FIG. 2A is a side view of an outside curled connector, 101, with an elastic member cord, 201, installed. The angle Gamma, Γ, defines the angle between the under surface of the top 102 and the surface of the bottom cord guide 106. The elastic cord member is installed where portions of the same cord are in frictional contact with each other. The elastic member cord wraps around the rebounder frame at 202. The elastic member knots, 203, retain the bottom legs, and the top loop, 204, hooks around the loop contact surface, 105, and runs under the top surface, 102. The bottom legs run along the bottom cord guide, 106, which is curved to raise the cord above the knots, 203. This brings the top and bottom legs of the elastic member together so they are just barely touching which allows the connector to have an extremely low profile.

Figure 2B:
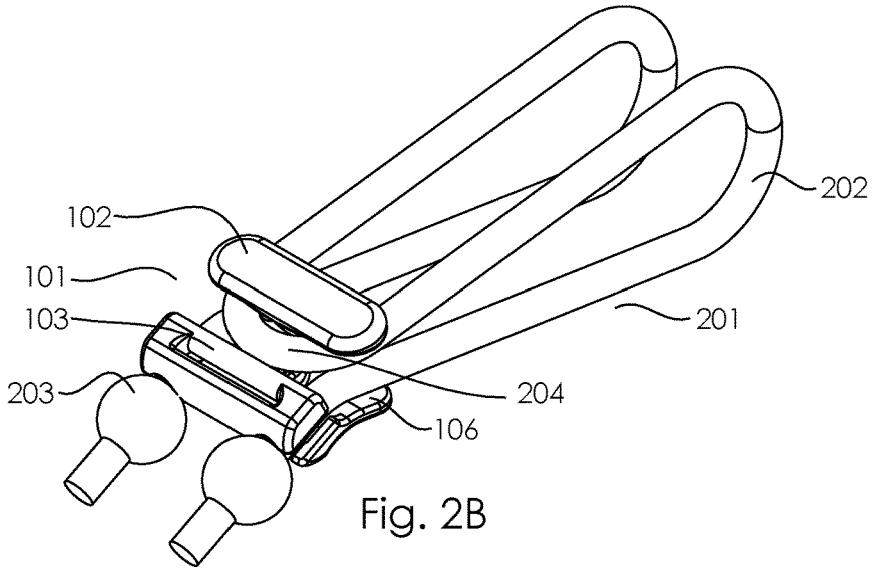
FIG. 2B is an upper rear isometric view of an outside curled connector with an elastic member cord installed.
Figure 2C:
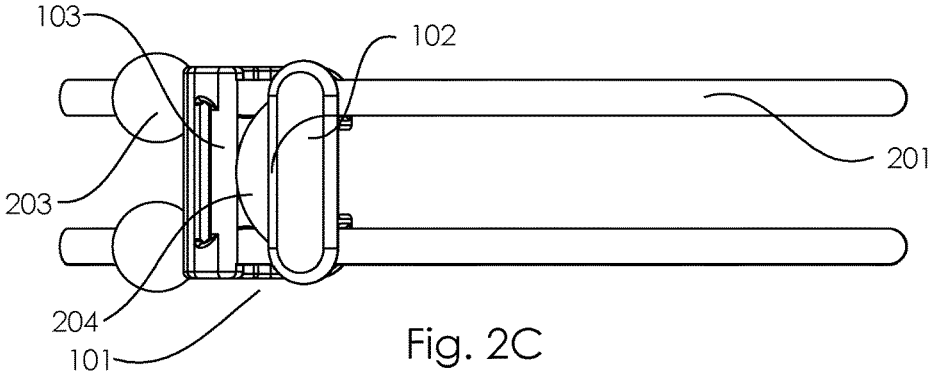
FIG. 2C is a bottom view of an outside curled connector with an elastic member cord installed.
Figure 2D:
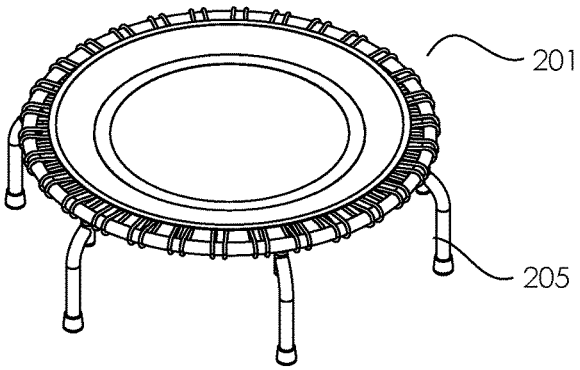
FIG. 2D shows a rebounder system, 205, using outside curled connectors.

FIG. 2B is an upper rear isometric view of an outside curled connector, 101, with an elastic cord installed, 201. FIG. 2C is a bottom view of an outside curled connector, 101, with an elastic member cord, 201 installed. This shows that the elastic member knots, 203, are held behind the mat strap bar, 103, which allows for a larger jumping surface. FIG. 2D shows a rebounder system, 205, using outside curled connectors.

FIG. 2A-2C show the unique connector top surface 102 utilized in a number of these connector embodiments. Traditionally elastic member connectors had tops that would extend over and cover the entire elastic member top loop 204. Typically, the connector tops would come to sharp corners because they were designed to have ample material to securely cover the elastic member top loop 204. This new design eliminates all of the material extending back and covering the elastic member top loop 204. The new connector top surface 102 is an oval shape that only extends out laterally, which resulted in sufficient hold retention of the top loop 204. There are two benefits to this improvement: First, the connector produces a much smoother and more comfortable feeling underfoot when the user steps on it; because the more pronounced and extended corners were replaced with smaller edges with rounded sides. The second improvement was that the mass of the part was noticeably diminished, which reduced weight and production costs of manufacture.

Figure 3A:
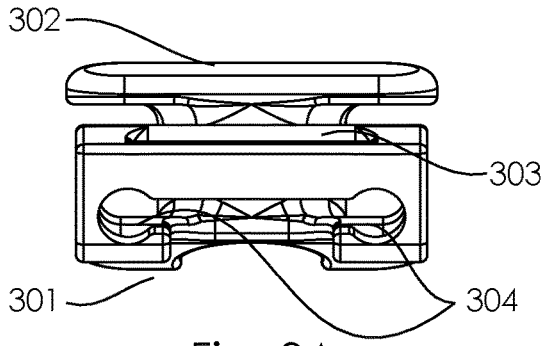
FIG. 3A is a rear view of an inside curled connector.
Figure 3B:
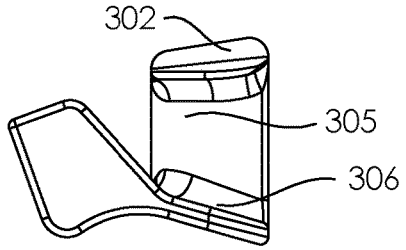
FIG. 3B is a side view of an inside curled connector.
Figure 3C:
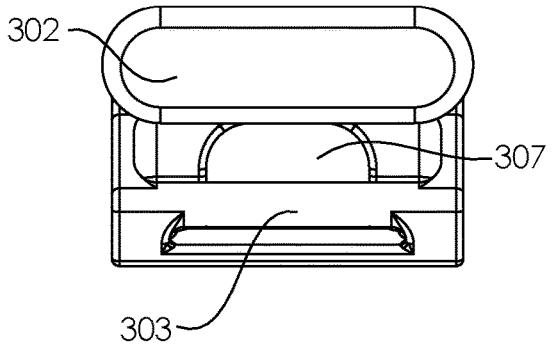
FIG. 3C is a top view of an inside curled connector.
Figure 3D:
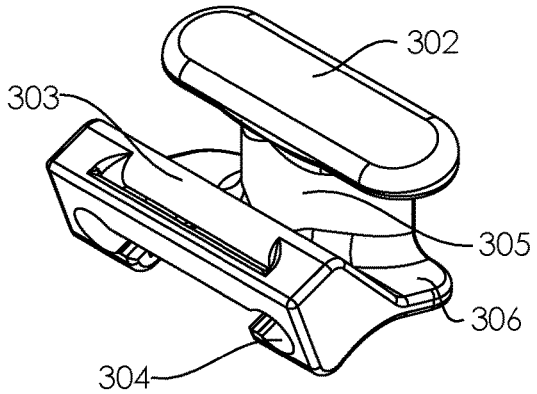
FIG. 3D is a rear isometric view of an inside curled connector.
Figure 3E:
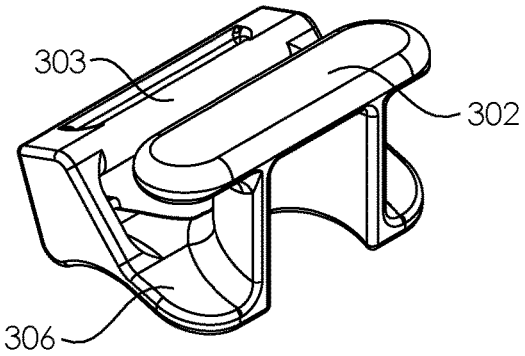
FIG. 3E is an upper front isometric view of an inside curled connector.
Figure 3F:
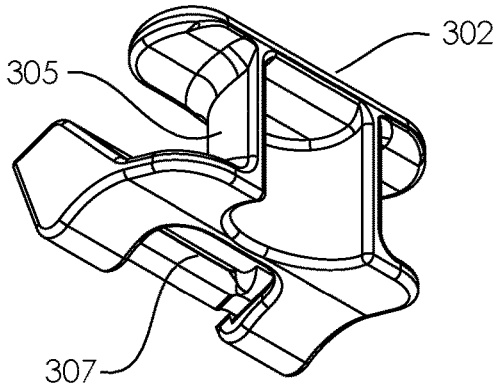
FIG. 3F is a lower front isometric view of an inside curled connector.

FIG. 3A is a rear view of an inside curled connector, 301. It is comprised of a top surface, 302, a mat strap bar, 303, and internal elastic member knot holes, 304. The inside curled connector, 301, is similar to the outside curled connector, 101, but the inside curled connector, 301, has the elastic member knots installed from the inside. FIG. 3B is a side view of an inside curled connector, 301. This view shows the loop contact surface, 305, and the bottom cord guide, 306. FIG. 3C is a top view of an inside curled connector. There is a middle cutaway, 307, which allows the cord to pass through during installation. This makes it more cumbersome to install the elastic member on this connector than the outside curled connector, 101, so the outside curled connector is preferred. FIG. 3D is a rear isometric view of an inside curled connector, 301. FIG. 3E is an upper front isometric view of an inside curled connector. FIG. 3F is a lower front isometric view of an inside curled connector.

Figure 4A:
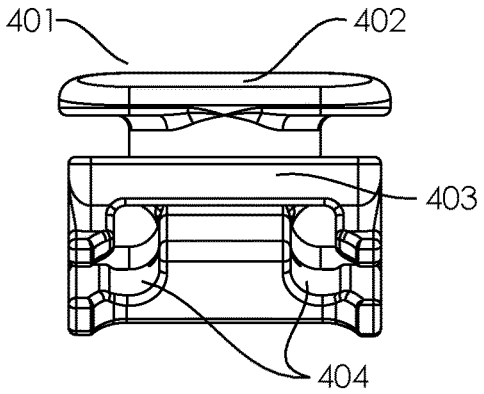
FIG. 4A is a rear view of a squeezed connector.
Figure 4B:
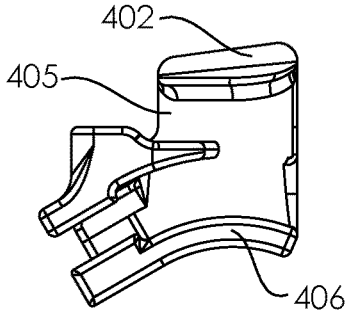
FIG. 4B is a side view of a squeezed connector.
Figure 4C:
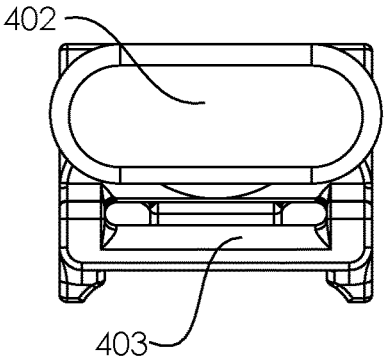
FIG. 4C is a top view of a squeezed connector.
Figure 4D:
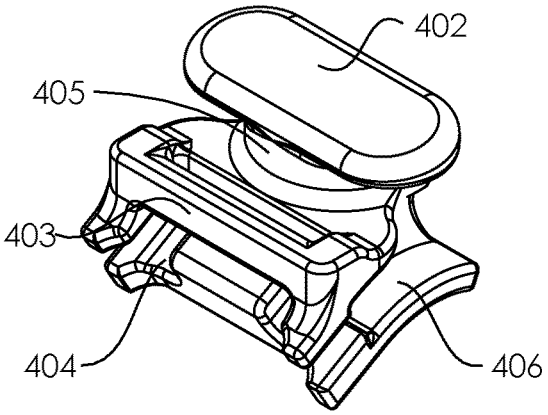
FIG. 4D is a rear isometric view of a squeezed connector.
Figure 4E:
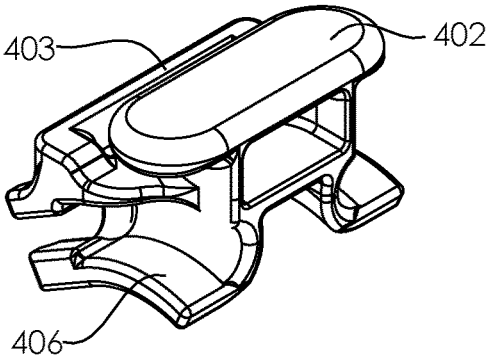
FIG. 4E is an upper front isometric view of a squeezed connector.
Figure 4F:
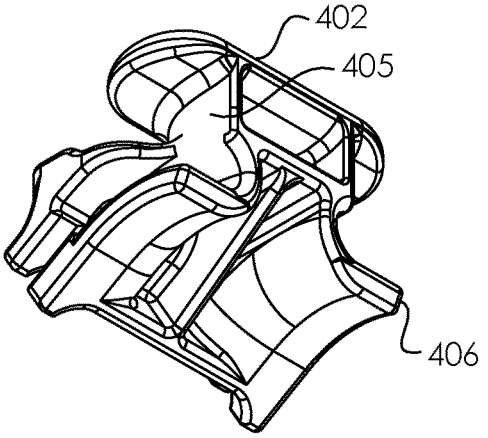
FIG. 4F is a lower front isometric view of a squeezed connector.

FIG. 4A is a rear view of a squeezed connector, 401. It is comprised of a top surface, 402, a mat strap bar, 403, and elastic cord knot holes, 404. FIG. 4B is a side view of a squeezed connector, 401. This view shows the loop contact surface, 405, and the bottom cord guide, 406. The knot side of the elastic cord runs up along the bottom cord guide, 406. This brings the knot side of the elastic cord into slight contact with the upper loop side of the cord which allows a low profile connector. FIG. 4C is a top view of a squeezed connector. FIG. 4D is a rear isometric view of a squeezed connector, 401. This shows that the loop contact surface, 405, is very close to the mat strap bar, 403. When the cord is installed, the top loop sits on the mat strap bar, 403. This allows the rebounder mat size to increase because there is less wasted length in the connector. FIG. 4E is an upper front isometric view of a squeezed connector. FIG. 4F is a lower front isometric view of a squeezed connector.

Figure 5A:
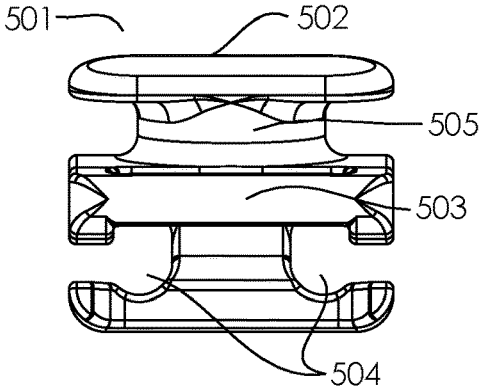
FIG. 5A is a rear view of an aligned connector.
Figure 5B:
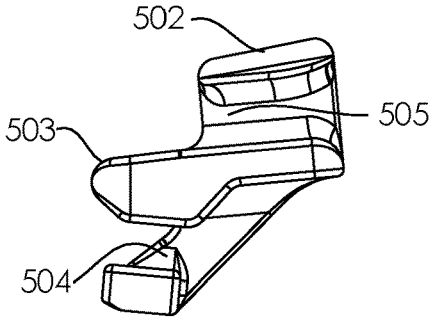
FIG. 5B is a side view of an aligned connector.
Figure 5C:
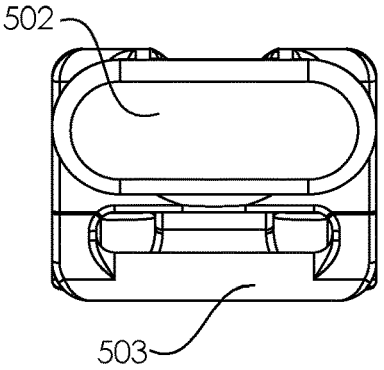
FIG. 5C is a top view of an aligned connector.
Figure 5D:
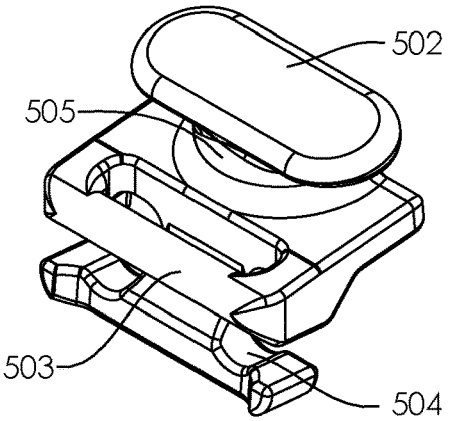
FIG. 5D is a rear isometric view of an aligned connector.
Figure 5E:
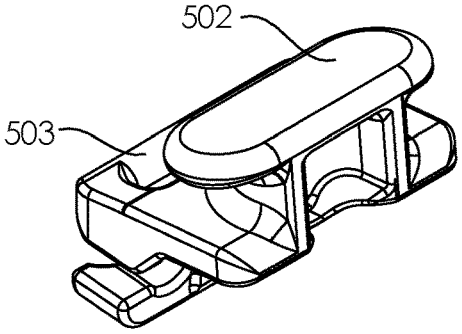
FIG. 5E is an upper front isometric view of an aligned connector.
Figure 5F:
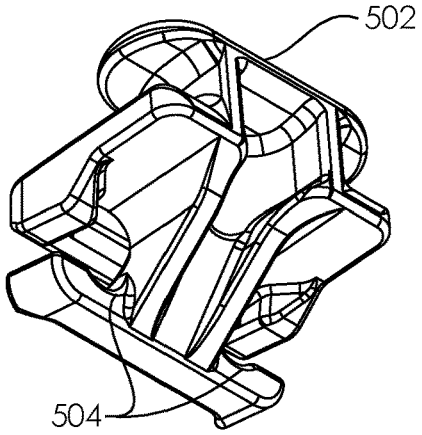
FIG. 5F is a lower front isometric view of an aligned connector.

FIG. 5A is a rear view of an aligned connector, 501. It is comprised of a top surface, 502, a mat strap bar, 503, bungee or other elastic type member's knot holes, 504, and a loop contact surface, 505. FIG. 5B is a side view of an aligned connector, 501. The loop contact surface, 505, is angled up, and the elastic cord knot holes, 504, are angled down. This is because the elastic member loop goes up and around the frame and the knots go down and under the frame. By aligning the connector with the elastic member path, it eliminates places where the elastic member has to bend and rub along the connector. As a result, elastic member life is increased. FIG. 5C is a top view of an aligned connector. FIG. 5D is a rear isometric view of an aligned connector, 501. FIG. 5E is an upper front isometric view of an aligned connector. FIG. 5F is a lower front isometric view of an aligned connector.

Figure 6A:
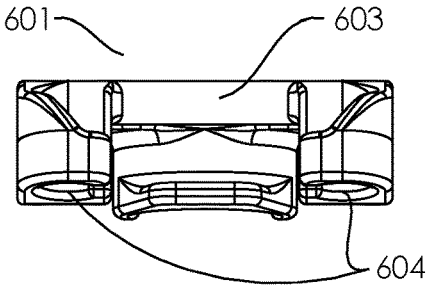
FIG. 6A is a rear view of an over the top connector.
Figure 6B:
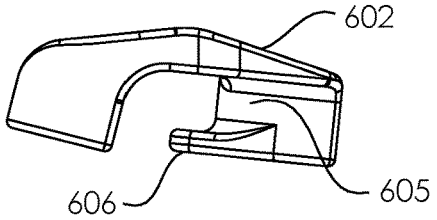
FIG. 6B is a side view of an over the top connector.
Figure 6C:
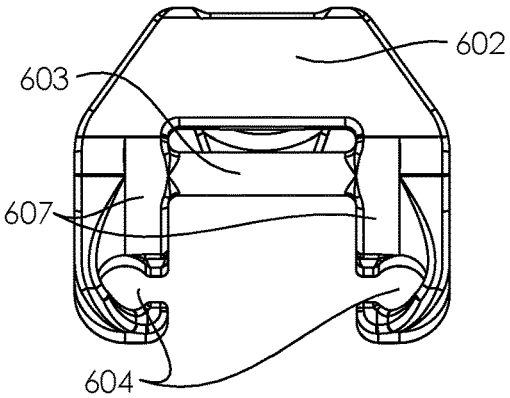
FIG. 6C is a top view of an over the top connector.
Figure 6D:
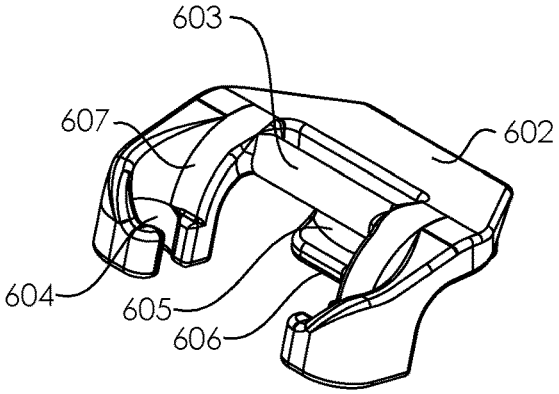
FIG. 6D is a rear isometric view of an over the top connector.
Figure 6E:
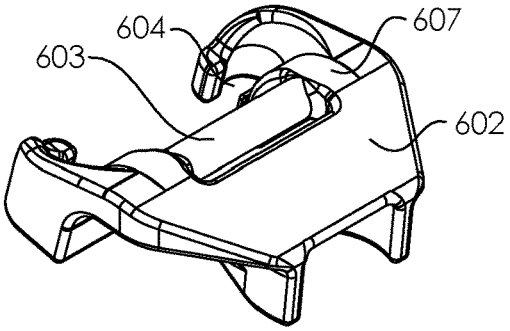
FIG. 6E is an upper front isometric view of an over the top connector.
Figure 6F:
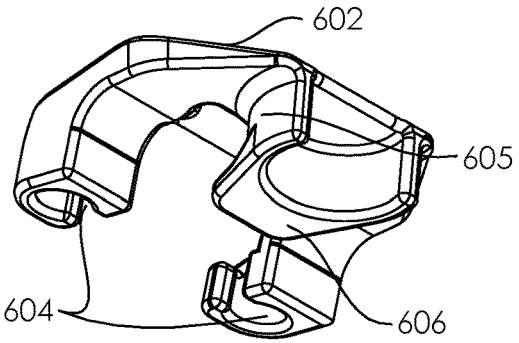
FIG. 6F is a lower front isometric view of an over the top connector.
Figure 6G:
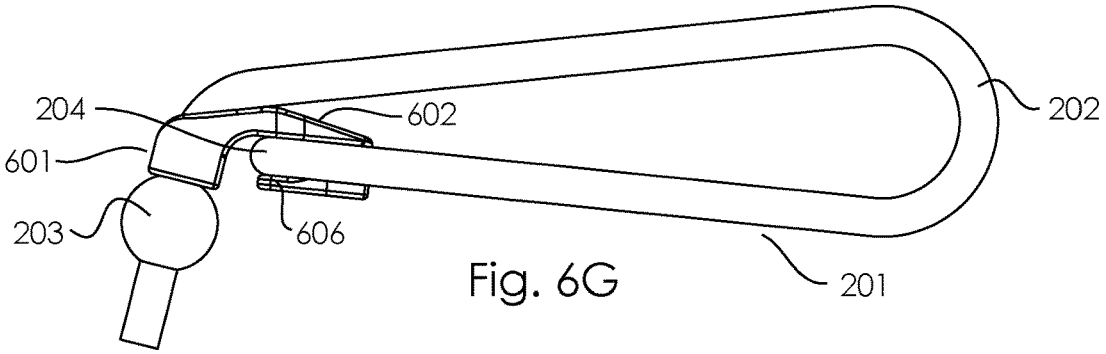
FIG. 6G is a side view of an over the top connector with an elastic member installed.

FIG. 6A is a rear view of an over the top connector, 601. It is comprised of a mat strap bar, 603, and vertical cord knot holes, 604. FIG. 6B is a side view of an over the top connector, 601. This view shows the top surface, 602, the loop contact surface, 605, and the loop retainer, 606. This connector has the bungees running up and over the top surface, 602, and the cord loop connects underneath the top surface, 602, along the loop contact surface, 605. FIG. 6C is a top view of an over the top connector. This shows the cord knot end contact surface, 607, which leads to the top surface, 602. FIG. 6D is a rear isometric view of an over the top connector, 601. FIG. 6E is an upper front isometric view of an over the top connector. FIG. 6F is a lower front isometric view of an over the top connector. FIG. 6F is a side view of an over the top connector, 601, with an elastic cord, 201, installed. The loop side, 204, runs under frame, and the knots, 203, runs over the connector, 601, and over the frame. This connector provides complete comfort when the user jumps on the connectors. The soft cord (or interchangeably another elastic type member) running along the top of the connector acts as a cushion which is more compliant than hard plastic surfaces.

Figure 7A:
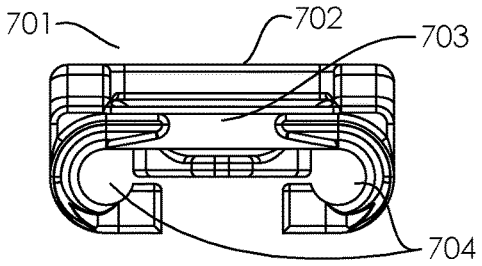
FIG. 7A is a rear view of an inverted loop connector.
Figure 7B:
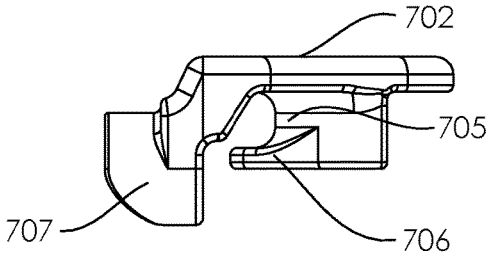
FIG. 7B is a side view of an inverted loop connector.
Figure 7C:
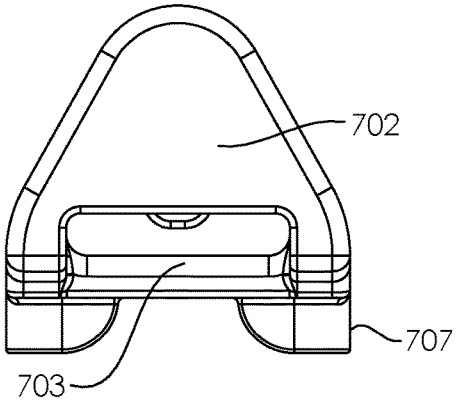
FIG. 7C is a top view of an inverted loop connector.
Figure 7D:
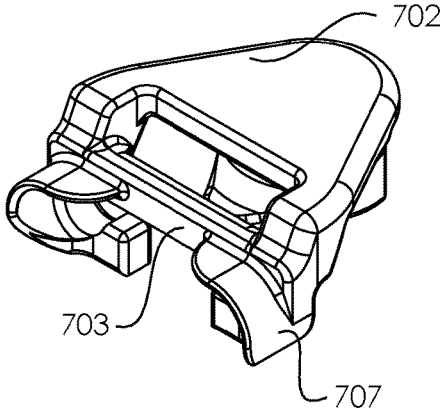
FIG. 7D is a rear isometric view of an inverted loop connector.
Figure 7E:
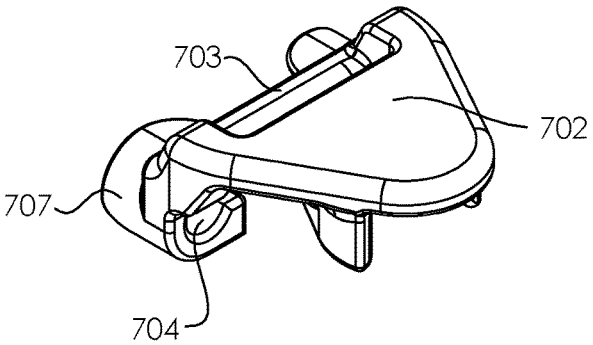
FIG. 7E is an upper front isometric view of an inverted loop connector.
Figure 7F:
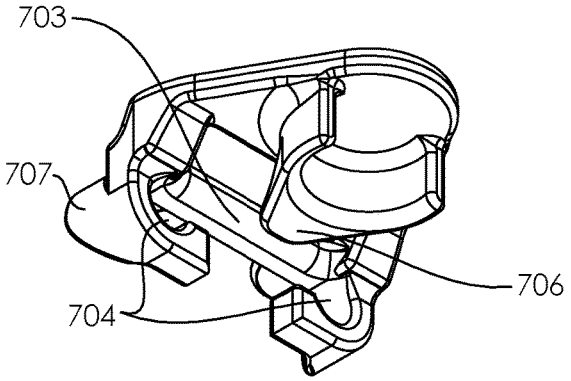
FIG. 7F is a lower front isometric view of an inverted loop connector.

FIG. 7A is a rear view of an inverted loop connector, 701. It is comprised of a top surface, 702, a mat strap bar, 703, and internal elastic member knot holes, 704. FIG. 7B is a side view of an inverted loop connector, 701. This view shows the loop contact surface, 705, the loop retainer, 706, and elastic member knot covers, 707. The knot covers provide a curved cup to support the elastic member knots, and they also improve the appearance by concealing the elastic member knots. The loop contact surface, 705, on this connector is underneath the connector in this design to provide a completely smooth top surface, 702. FIG. 7C is a top view of an inverted loop connector. FIG. 7D is a rear isometric view of an inverted loop connector, 701. The mat strap bar, 703, makes up the top of the elastic member knot holes, 704. This allows the knots to be held far back which allows for a larger mat size. FIG. 7E is an upper front isometric view of an inverted loop connector. The knot holes, 704, are lined up with where the elastic member loop wraps around the loop contact surface, 705, so the top and bottom of the elastic member slightly rub when in use. This makes the connector as compact and low profile as possible. FIG. 7F is a lower front isometric view of an inverted loop connector.

Figure 8A:
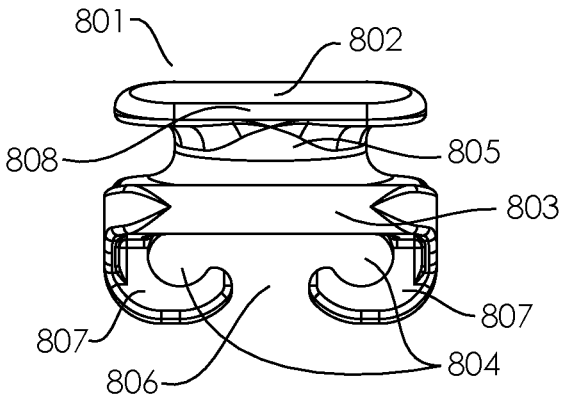
FIG. 8A is a rear view of a low profile aligned connector with internal holes.

FIG. 8A is a rear view of a low profile aligned connector with internal holes, 801. It is comprised of a top surface, 802, a mat strap bar, 803, internal elastic cord knot holes, 804, a loop contact surface, 805, an internal slot, 806, internal knot hooks, 807, and a top surface rear lip 808. This connector has internal knot holes 804, as opposed to the external knot holes 504, as shown in FIG. 5A. To install a cord in this embodiment, one must insert each elastic cord end through the internal slot 806 and into each internal cord knot hole 804. The internal knot hooks 807 secure the cords and prevents the elastic cords from slipping out of the connector 801 during use. The benefit of the compact and low profile connector permitted the movement of the mat strap bar 803 closer to front of the connector which in turn permits an increase in mat diameter of 16 mm. For a 39" size rebounder model, this is a mat diameter increase of 631 mm to 647 mm which is a 5.1% increase in jumping area. With the extremely tight tolerances and available space in which to work, this represents a significant improvement.

Figure 8B:
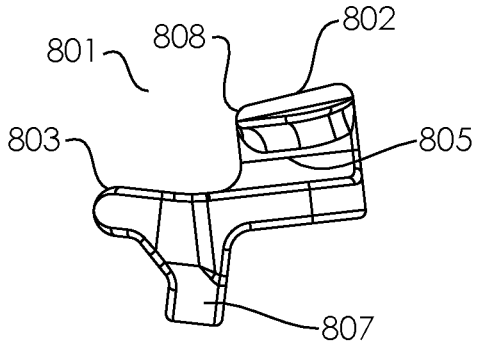
FIG. 8B is a side view of a low profile aligned connector with internal holes.

FIG. 8B is a side view of a low profile aligned connector with internal knot holes, 801. Just like the aligned connector shown in FIG. 5, this connector also has an angled up loop contact surface 805 and the cord knot holes 804 are angled down. This is done to align the connector with the path the elastic cord travels around the frame, which in turn, reduces stresses and rubbing and substantially improves cord life. The improvement of this design is significant. Testing has shown an average 28% improvement of elastic cord life compared to when the same cord is coupled to prior connectors. The reason for the increased life of the elastic cord when connected to this new design is that the elastic cord member does not bend and contort when coupled in the manner of prior connectors. Old style connectors disposed the slots such that they were lined up parallel to each other; but, the elastic cord did not exit the connector in a parallel direction. The top portion of the cord connects to the top of the connector and then is stretched over the trampoline frame rail. The non-parallel extension of the cord members causes increased pressure, friction, and wear, shortening the cords safe lifespan.

The bottom portion of the elastic cord terminates with knots on the ends, which then hook or attach into the bottom or lower portion of the connector; and then the cord is stretched under the frame rail. The new connectors angled top and bottom portions align with the direction that the elastic cord must travel to wrap around the frame rail. The top portion of the connector is angled up and the bottom portion is angled down. The top portion of the elastic cord goes up over the frame, and the bottom portion goes down under the frame, so they end up being bent with a sharp corner as they leave the parallel connector. The new angled connector slots and holes are aligned with the path of the elastic member. This means the cord is not bent as it goes up and over the frame, or down and under the frame.

Figure 8C:
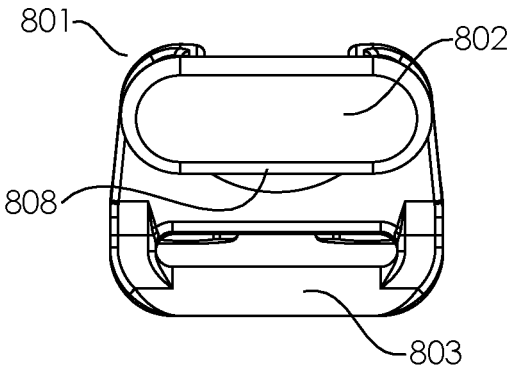
FIG. 8C is a top view of a low profile aligned connector with internal holes.
Figure 8D:
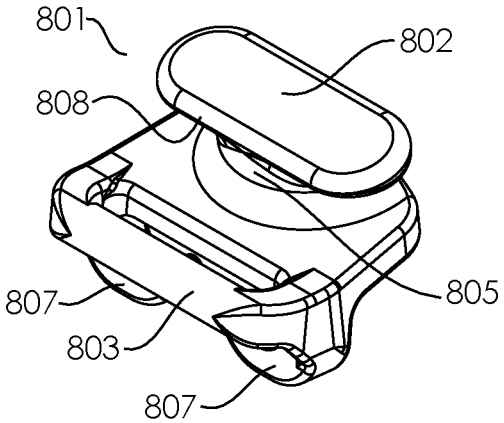
FIG. 8D is a rear isometric view of a low profile aligned connector with internal holes.
Figure 8E:
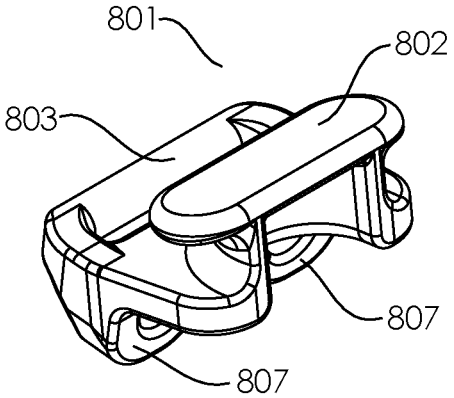
FIG. 8E is an upper front isometric view of a low profile aligned connector with internal holes.
Figure 8F:
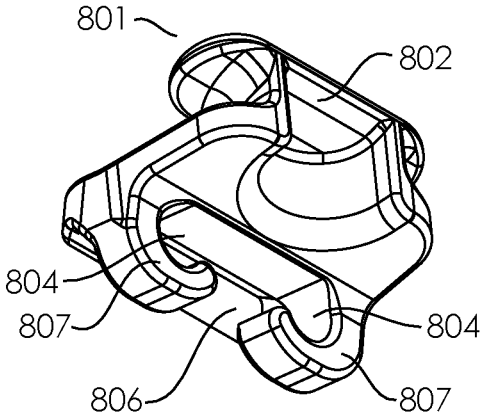
FIG. 8F is a lower front isometric view of a low profile aligned connector.

FIG. 8C is a top view of a low profile aligned connector with internal holes 801. FIG. 8D is a rear isometric view of a low profile aligned connector with internal holes 801. FIG. 8E is an upper front isometric view of a low profile aligned connector with internal holes 801. FIG. 8F is a lower front isometric view of a low profile aligned connector 801.

Figure 8G:
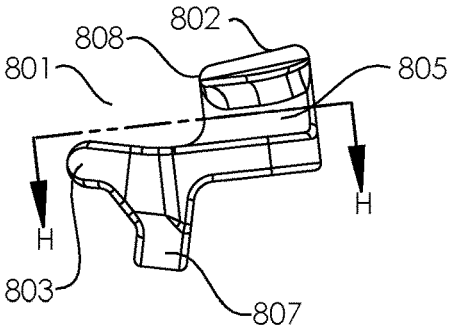
FIG. 8G is a side view of a low profile aligned connector with internal holes.
Figure 8H:
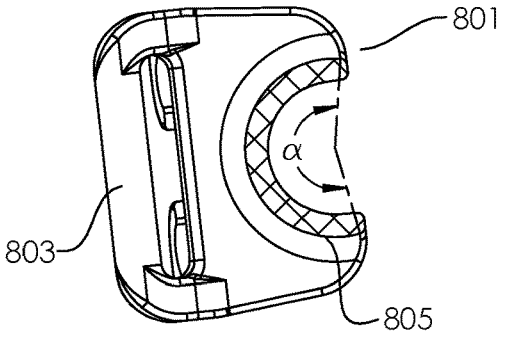
FIG. 8H is a cross section view of a low profile aligned connector with internal holes.
Figure 8I:
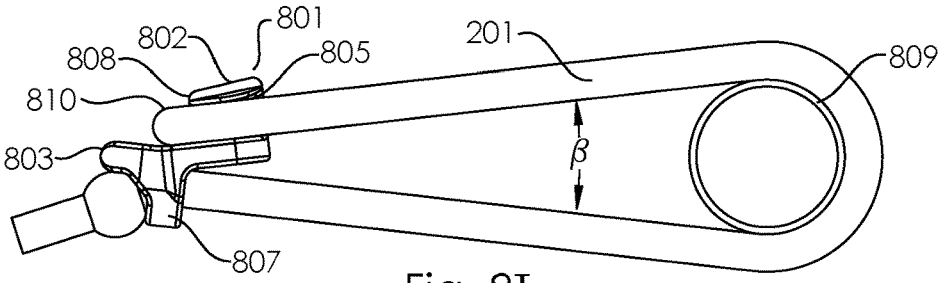
FIG. 8I is a side view of a low profile aligned connector with internal holes with an elastic cord installed on the connector and frame rail.
Figure 8J:
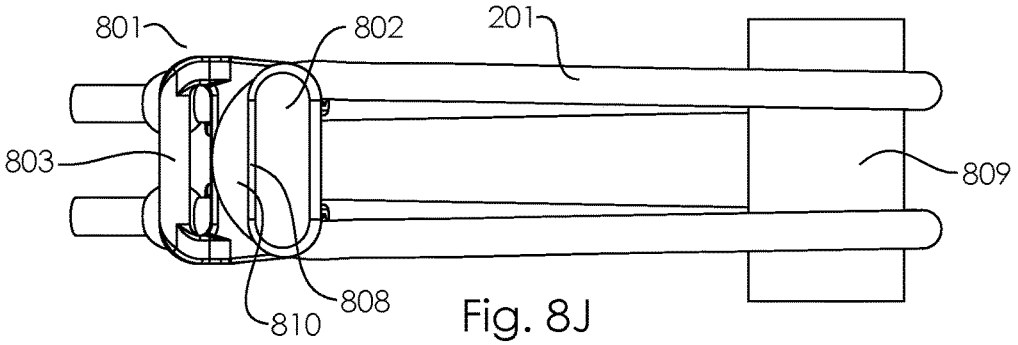
FIG. 8J is a top view of the assembly shown in 8I.
Figure 8K:
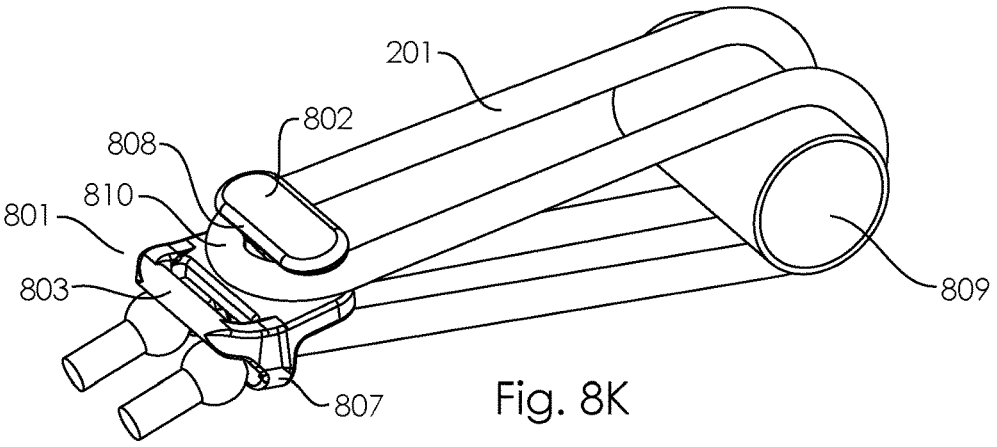
FIG. 8K is an angled top view of the assembly shown in 8I.

FIG. 8G is a side view of a low profile aligned connector with internal holes 801. FIG. 8H is a cross section going through the loop contact surface 805 of FIG. 8G. This shows that even when it is angled up, the loop angle, a, is extended beyond 180 degrees. FIG. 8I is a side view showing a bungee (or elastic member, or cord) 201 installed on the connector 801 and wrapped around the frame rail 809. This shows the optimal angle, β, which the bungee 201 takes to wrap around the frame rail 809. The connector 801 is optimally angled so that the angle between the orientation of the loop contact surface 805 and the internal knot hooks 807 matches the optimal angle β. The top surface rear lip 808 does not completely cover the elastic cord (or bungee) loop 810 that goes around the connector loop contact surface 805. This is an intentional improvement because a gradual slope is created between the rear lip 808 and the elastic cord loop 810. The cord loop 810 is cushioned and this provides a smooth sloping transition such that a user is less likely to feel a hard corner impact when landing on the connectors 801. FIG. 8J is a top view showing the bungee 201 installed on the connector 801 and frame rail 809. FIG. 8K is an upper angled view of a bungee 201 installed on the connector 801 and frame rail 809.

Figure 9A:
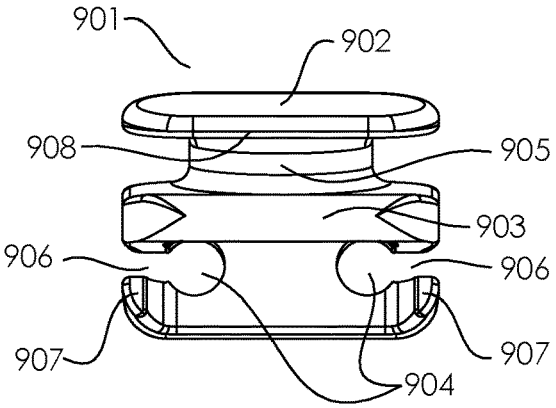
FIG. 9A is a rear view of a low profile aligned connector.

FIG. 9A is a rear view of a low profile aligned connector with external holes, 901. It is comprised of a top surface, 902, a mat strap bar, 903, lower receiving channels, 904, an upper receiving channel 905, external slots, 906, external knot hooks, 907, and a top surface rear lip 908. This connector has external knot holes 904, as opposed to the internal knot holes 804, as shown in FIGS. 8A-K. To install a cord in this embodiment, one inserts each elastic cord end through the external slot 906 and into each external cord knot hole 904. The external knot hooks 907 secure the cord more easily for many users than the internal knot holes 804. The external holes have been configured to retain the knots more effectively when compared to the external holes of 504, and so effectively prevent the elastic cords from slipping out of the connector 901 during use. The improved disclosed low profile aligned connector with external retention 901 is an effective means of retaining the elastic cords during use, while at the same time, maintaining the improved lower profile, and providing easier attachment and detachment of the cord ends. The benefit of the compact and low profile connector permitted the movement of the mat strap bar 903 closer to front of the connector which in turn permits an increase in mat diameter of 16 mm. For a 39" size rebounder model, this is a mat diameter increase of 631 mm to 647 mm which is a 5.1% increase in jumping area. With the extremely tight tolerances and available space for fitness sized trampolines and rebounders in which to work; this represents a relatively significant improvement.

Figure 9B:
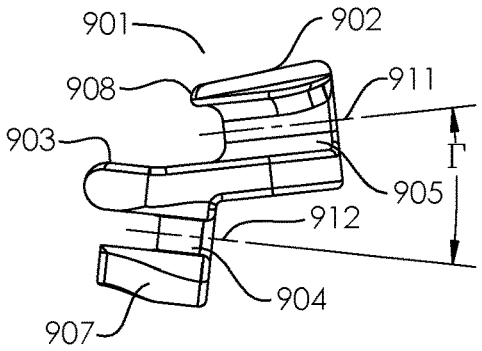
FIG. 9B is a side view of a low profile aligned connector.

FIG. 9B is a side view of a low profile aligned connector with external knot holes, 901. Just like the aligned connector shown in FIG. 8, this connector also has an angled up upper receiving channel 905 and the lower receiving channels 904 are angled down. The upper receiving channel 905 has an upper centerline 911 which divides the upper receiving channel 905 in half when viewed from the side. The lower receiving channels 904 have a lower centerline 912 which divides the lower receiving channel 904 in half when viewed from the side. The gamma angle Γ is defined as the angle between the upper centerline 911 and the lower centerline 912 when viewed from the side. This is done to align the connector with the path the elastic cord travels around the frame, which in turn, reduces stresses and rubbing and substantially improves cord life. The improvement of this design is significant. Testing has shown an average 28% improvement of elastic cord life compared to when the same cord is coupled to prior connectors. This represents a significant progression in the art over prior designs or what was available in the market.

The reason for the increased life of the elastic cord when connected to this new design is that the elastic cord member does not bend and contort when coupled in the manner of prior connectors. Old style connectors disposed the slots such that they were lined up parallel to each other; but, the elastic cord did not exit the connector in a parallel direction. All other current and prior elastic cord connectors function in this manner. The top portion of the cord connects to the top of the connector and then is stretched over the trampoline frame rail. The non-parallel extension of the cord members causes increased pressure, friction, and wear along the cord, shortening the cords safe or usable lifespan.

The bottom portion of the elastic cord terminates with knots (or other bulbous or enlarged portions) on the ends, which then hook or attach into the bottom or lower portion of the connector; and then the cord is stretched under the frame rail. The new connectors angled top and bottom portions better align with the direction that the elastic cord must travel to wrap around the frame rail. The top portion of the connector is angled up and the bottom portion is angled down. The top portion of the elastic cord goes up over the frame, and the bottom portion goes down under the frame, so they end up being bent with a sharp corner as they leave the parallel connector. The new angled connector slots and holes are aligned in parallel along the path of the elastic member. This means the cord is not bent nearly as much, if at all, as it goes up and over the frame, or down and under the frame.

Figure 9C:
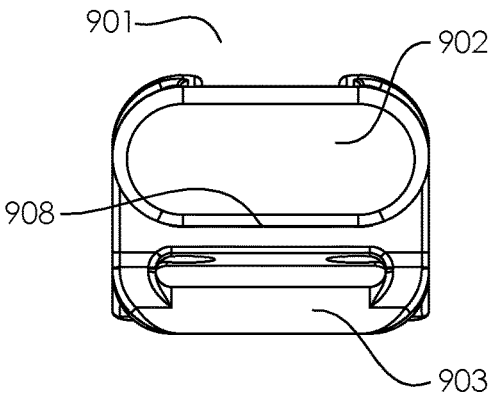
FIG. 9C is a top view of a low profile aligned connector.
Figure 9D:
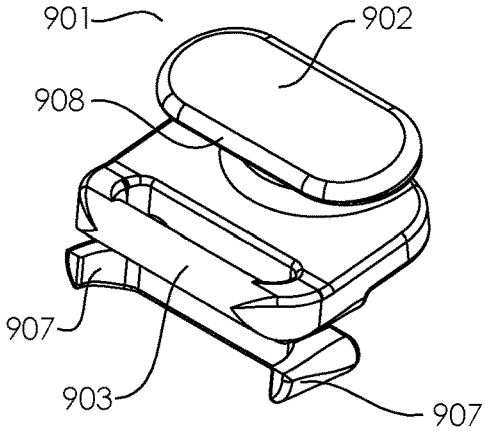
FIG. 9D is a rear isometric view of a low profile aligned connector.
Figure 9E:
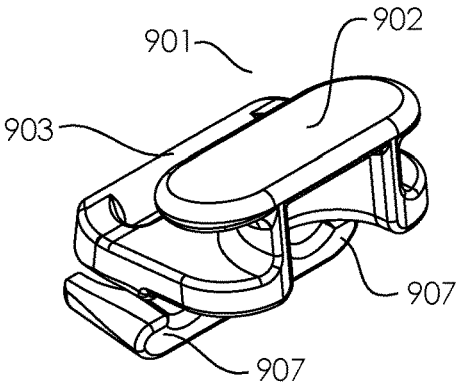
FIG. 9E is an upper front isometric view of a low profile aligned connector.
Figure 9F:
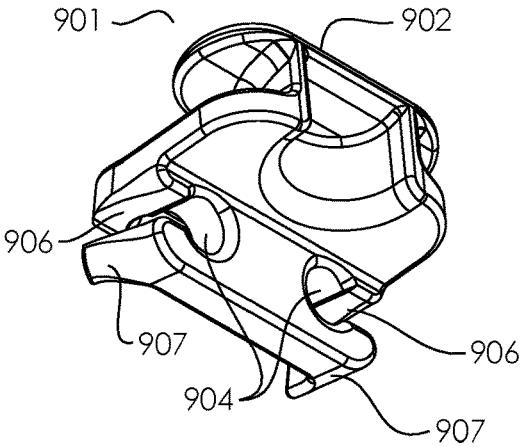
FIG. 9F is a lower front isometric view of a low profile aligned connector.

FIG. 9C is a top view of a low profile aligned connector with external holes 901. FIG. 9D is a rear isometric view of a low profile aligned connector with external holes 901. FIG. 9E is an upper front isometric view of a low profile aligned connector with external holes 901. FIG. 9F is a lower front isometric view of a low profile aligned connector 901.

Figure 9G:
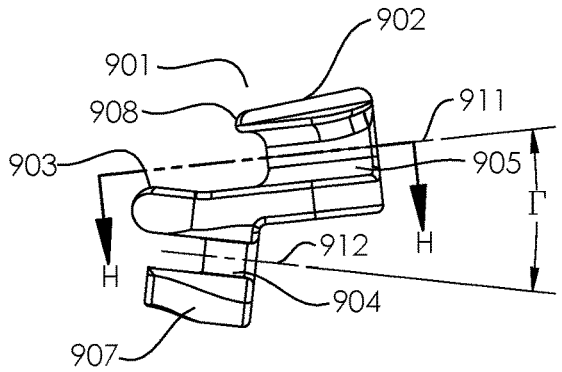
FIG. 9G is a side view of a low profile aligned connector.
Figure 9H:
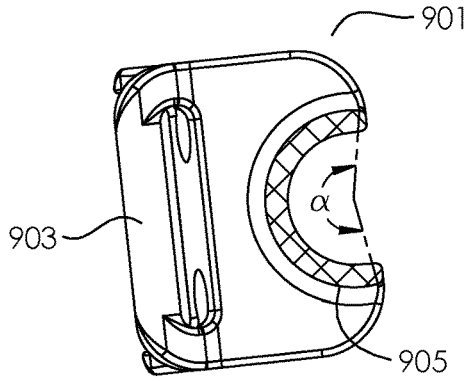
FIG. 9H is a cross section view of a low profile aligned connector.
Figure 9I:
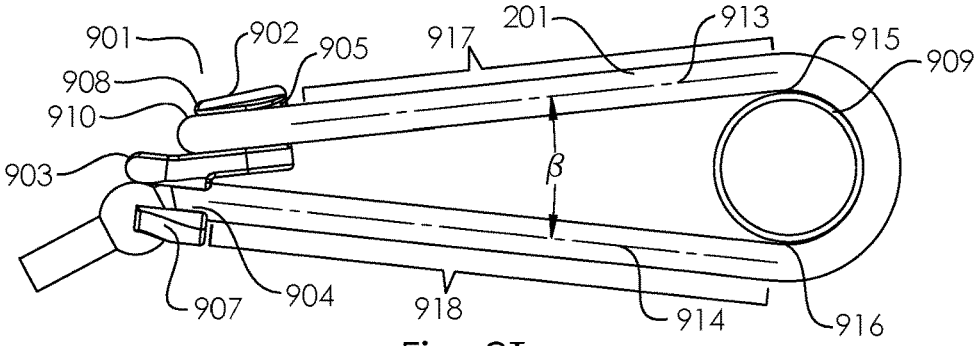
FIG. 9I is a side view of a low profile aligned connector with an elastic cord installed on the connector and frame rail.
Figure 9J:
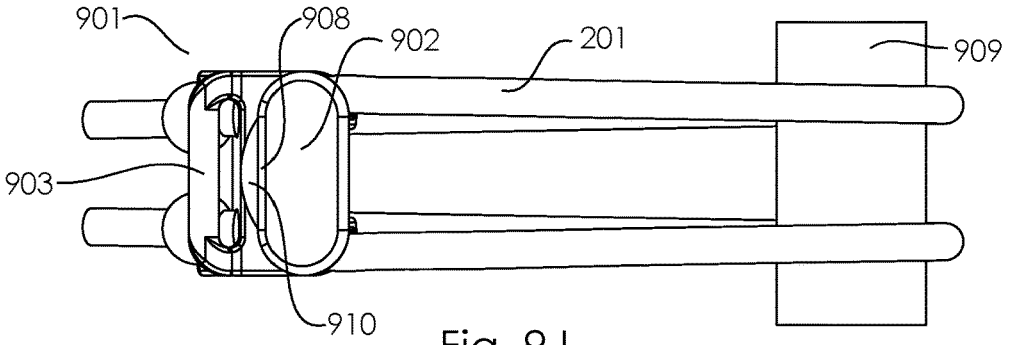
FIG. 9J is a top view of the assembly shown in 9I.
Figure 9K:
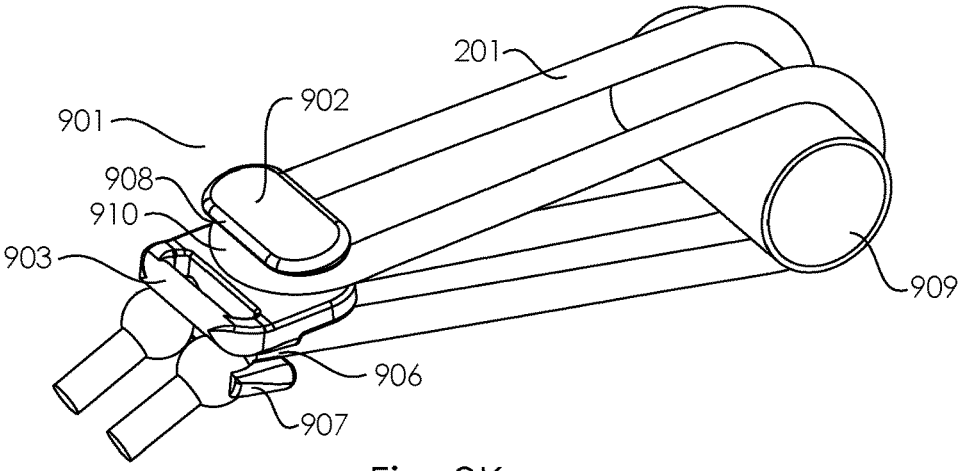
FIG. 9K is an angled top view of the assembly shown in 9I.

FIG. 9G is a side view of a low profile aligned connector with external holes 901. FIG. 9H is a cross section going through the loop contact surface 905 of FIG. 9G. FIG. 9H shows that even when it is angled up, the loop angle, Alpha a, is extended beyond 180 degrees. FIG. 9I is a side view showing a cordlike flexible elastic member 201 installed on the connector 901 and wrapped around the frame member 909. The upper portion 917 of the cord 201 has an upper axis 913 that passes through the centroid of the cord cross section and extends along the straight path of the cord. The upper portion 917 spans between the upper receiving channel 905 and the point where the cord 201 tangentially contacts the top of the frame member 915. The lower portion 918 of the cord 201 has a lower axis 914 that passes through the centroid of the cord cross section and extends along the straight path of the cord. The lower portion 918 spans between the lower receiving channel 904 and the point where the cord 201 tangentially contacts the bottom of the frame member 916. This shows the optimal angle Gamma Γ of the cord receiving channels, and Beta β, which is the angle between the upper axis 913 and the lower axis 914. The connector angle gamma is configured to be the same as the Beta angle. This ensures that the connector is in balance and will not twist such that it minimizes the size of the connector protruding upward. The top surface rear lip 908 extends back and partially covers the bungee loop 910 that goes around the loop contact surface 905. This is a bit different than in FIG. 8, but it still creates a smooth transition between the connector top surface 902 and bungee loop 910 so it is not protruding underfoot when a footfall lands on the connector while jumping, 901. FIG. 9J is a top view showing the elastic cord member (bungee) 201 installed on the connector 901 and frame rail 909. FIG. 9K is an upper angled view of a bungee 201 installed on the connector 901 and frame rail 909.

Figure 10A:
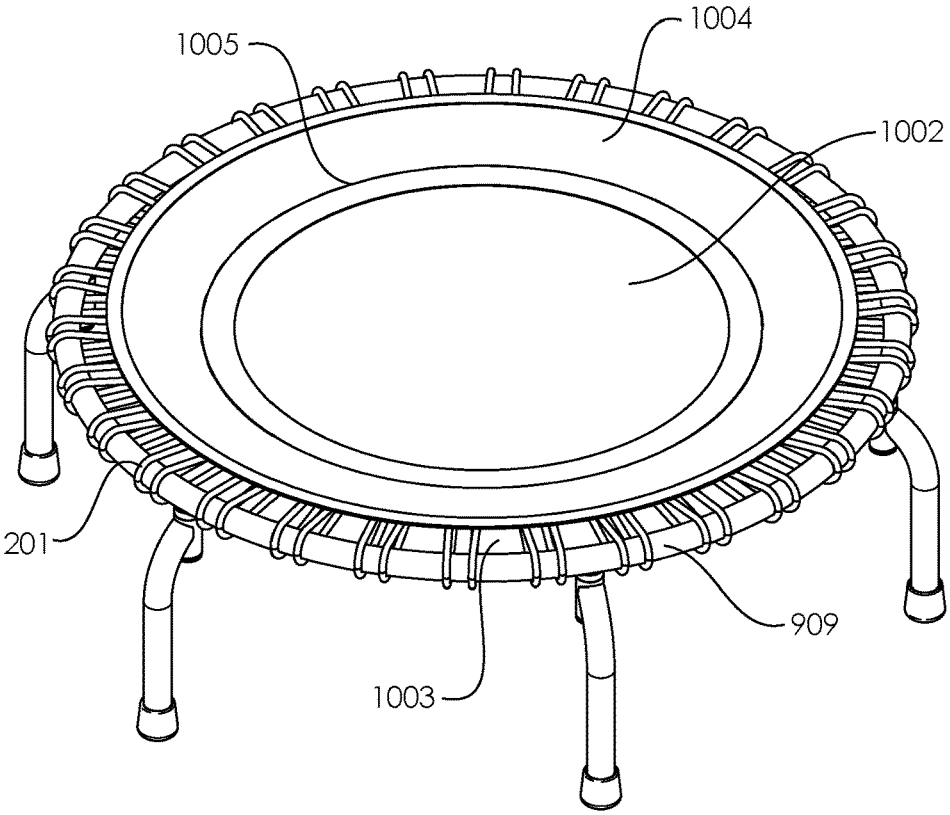
FIG. 10A is an isometric view of a rebounder system.

FIG. 10A shows an entire rebounder system. It is comprised of a frame member 909, a central opening 1003, a rebounder mat 1004, and a plurality of cordlike flexible elastic members 201. The rebounder mat 1004 is a central portion 1002 with a central portion perimeter 1005.

Figure 10B:
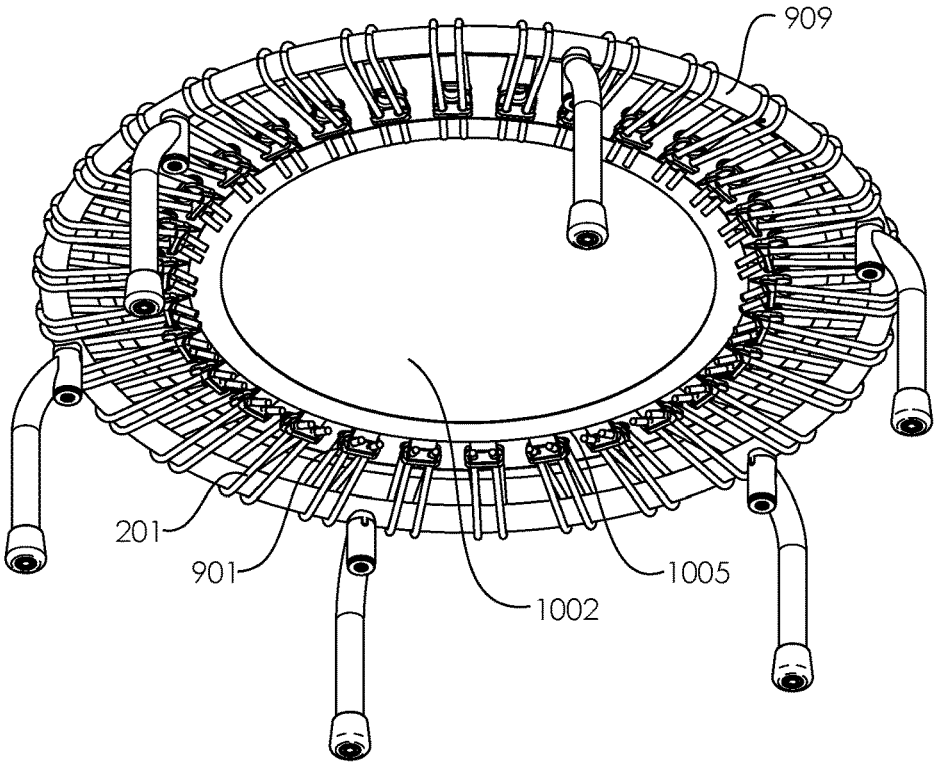
FIG. 10B is a lower isometric view of a rebounder system.

FIG. 10B shows the bottom side of an entire rebounder system. The connectors 901 are sewn to the perimeter of the central portion of the mat 1005. The cordlike flexible elastic members 201 attach to the connectors 901 and wrap around the frame member 909.

The result is a trampoline with a frame has a rebounding mat that is tensioned to the frame with a plurality of flexible and cordlike linear elastic members. Preferably each cordlike elastic member is connected to the frame with at least one connector retaining the cord such that the cord is disposed at an angle between 0 degrees and 25 degrees. Also shown are connectors with the described angles, and where the ends of the cords are retained with internally or externally oriented knot retention openings. The optimal angle depends on the geometry of the rebounder specifically the diameter of the frame rail and the distance between the connectors and the frame rail. The angles are described as the Gamma angle of the connector and the Beta angle of the extending cord portions. If the frame rail diameter is large, and the cord is close to the frame, the angle between the top and bottom portions of the elastic cord extending around the frame will be larger. If the frame rail diameter is small and the cord is farther from the frame, the angle between the top and bottom portions of the elastic cord will be smaller. For the more common rebounder the designs and sizes (generally less that 50 inches of jump surface, the optimal angle between the top and bottom connection points on the connector is are more optimally between 10 and 15 degrees. The alternative positions permit a tensioning process that extends the lifetime of elastic cords having a fabric sheath. The cord members are permitted to contact and also compress against each other at rest and during use.

APPENDIX A

Cord and Knot Tests

This table compares the results of tests done on the previous connector with parallel connection points compared to the new improved connector design with the top and bottom connection points angled apart from each other. This shows that the average life for elastic cords on the original connector when cycled with a 4-inch stroke is 1,227,000 cycles. The average life for bungees tested with the angled connector is 1,580,000 cycles which is a 28% improvement over the prior design.

| Test Number | Bungee Diameter [mm] | Stroke [in] | Knot Lengths [in] | Connector Type | 1st knot change | 2nd knot change | Total Number of Cycles |
|---|---|---|---|---|---|---|---|
| 93 | 8 | 4 | 19-20-21 | Original | 690,500 | 1,029,10 | 1,300,00 |
| 105 | 8 | 4 | 19-20-21 | Original | 612,300 | 1,202,22 | 1,400,00 |
| 106 | 8 | 4 | 19-20-21 | Original | 612,300 | 1,099,44 | 1,231,20 |
| 134 | 9 | 4 | 20-21-22 | Original | 171,500 | 769,100 | 977,000 |
| 138 | 9 | 4 | 20-21-22 | Angled | 72,800 | 578,400 | 1,560,000 |
| 159 | 9 | 4 | 20-21-22 | Angled | 77,900 | 675,400 | 1,600,000 |

Test Set-Up

Put bungee on test machine at specified knot setting

Ran machine for a number of cycles at 60 rpm

Stroke set to pull installed bungee 4 inches

Load cell measured average maximum force and average minimum force

Common Elastic Member or Cords

Below is a table of common bungee or elastic cord specifications used in testing, and a description of selection criteria: The knot lengths were set to achieve target tension in the elastic cord tension range when stretched 3 inches. Elastic cords were then installed on a test machine with the same initial stretch as the actual rebounding apparatus. The machine stretched the cords at a fixed stroke. The range of stretch strokes we tested was between 3-7 inches. The bungee tension would degrade over time, and once the minimum force dropped below 15 pounds, the cord was tightened to the next knot. This procedure continued until there were no more knots. The number of cycles required to complete the test were compared among the various cords, and the cord that lasted the longest was selected. Other causes of failure included too much abrasion and wear on the frame tube, a decrease in aesthetic appearance of the bungee cord, and a maximum force that exceeded the stretched bungee tension range.

| | |
|---|---|
| Bungee cord stiffness range | 9-20 lb/in |
| Range of bungee diameter | 8-10 mm |
| Bungee elastic material | Natural Latex Rubber |
| Bungee sheathing material | Polyester |
| Range of number of elastic strands | 70-140 |
| Range of bungee sheathings | 24 × 24, 24 × 16, 24 single braid, 16 single braid |
| Knot spacing | .7-1.25 inches |
| Range of knot lengths | 17.5-23.5 inches |
| Minimum Bungee Low Tension | 15 pounds |
| Bungee Tension range when stretched 3 inches | 30-60 pounds |

I claim:

1. A rebounding device comprising:

a frame member that defines a central opening, a rebounding mat having at least a central portion that is elastically supported by the frame member, that is located within the central opening, and that has an upper surface, a plurality of connectors attached to the central portion at a perimeter of the central portion, at least one cordlike flexible elastic member that extends between at least one of the plurality of connectors and the frame member, the at least one of the plurality of connectors having an upper receiving channel and a lower receiving channel, the upper receiving channel having an upper centerline and the lower receiving channel having a lower centerline, the upper and lower centerlines extending at an gamma angle relative to one another as viewed parallel to the upper surface and perpendicularly to at least one of the upper centerline and the lower centerline, wherein the gamma angle is between 5 and 25 degrees.

2. The rebounding device according to claim 1, wherein the at least one cordlike flexible elastic member comprises an upper portion that has an upper axis and that extends from the upper receiving channel to a tangent location at the top of the frame member, the at least one cordlike flexible elastic member comprises a bottom portion that has a lower axis and that extends from the lower receiving channel to a tangent location at the bottom of the frame member, and the axis of the upper portion and the axis of the lower portion extend at an beta angle relative to one another as viewed parallel to the upper surface and perpendicularly to at least one of the axes of the upper portion and the lower portion, and the beta angle is between 5 and 25 degrees.

3. The rebounding device according to claim 2 wherein the gamma angle is between 9 and 15 degrees, and the beta angle is between 9 and 15 degrees.

4. The rebounding device according to claim 2 wherein the gamma angle is between 5 and 25 degrees when viewed perpendicularly to the upper axis.

5. The rebounding device according to claim 2 wherein the gamma angle is between 5 and 25 degrees when viewed perpendicularly to the lower axis.

6. The rebounding device according to claim 2 wherein the beta angle is the same as the gamma angle.

7. The rebounding device according to claim 2 wherein the beta angle is between 5 and 25 degrees when viewed perpendicularly to the upper axis.

8. The rebounding device according to claim 2 wherein the beta angle is between 5 and 25 degrees when viewed perpendicularly to the lower axis.

9. The rebounding device according to claim 1 wherein a portion of the upper receiving channel flares toward the frame member.

10. The rebounding device according to claim 9 wherein:

the upper receiving channel is defined by at least one surface that terminates at an opening that faces the frame member, and the at least one surface flares toward the opening such that a gap is defined between the at least one flexible elastic member and an uppermost portion of the at least one surface at a location of the opening.

11. The rebounding device according to claim 1 wherein the at least one cordlike flexible elastic member comprises an upper portion that has an upper axis and that extends from the upper receiving channel to a tangent location at a top of the frame member, the at least one cordlike flexible elastic member comprises a bottom portion that has a lower axis and that extends from the lower receiving channel to a tangent location at a bottom of the frame member, and the upper portion and the lower portion extend at an beta angle relative to one another as viewed perpendicularly to both the upper axis and the lower axis, the beta angle depending on a diameter of the frame, distance of the at least one of the connector to the frame and a separation of the upper and lower receiving channels on the at least one of the connectors, the beta angle being between 5 and 25 degrees wherein, the gamma angle between the upper centerline and the lower centerline is selected to match the beta angle.

12. A rebounding device comprising:

a frame member that defines a central opening, a rebounding mat having at least a central portion that is elastically supported by the frame member, that is located within the central opening, and that has an upper surface, a plurality of connectors attached to the central portion at the perimeter of the central portion, at least one cordlike flexible elastic member that extends between at least one of the plurality of connectors and the frame member, at least one of the plurality of connectors having an upper receiving channel and a lower receiving channel, the at least one cordlike flexible elastic member comprises an upper portion that has an upper axis and that extends from the upper receiving channel to a tangent location at the top of the frame member, the at least one cordlike flexible elastic member comprises a bottom portion that has a lower axis and that extends from the lower receiving channel to a tangent location at a bottom of the frame member, the upper receiving channel having an upper centerline and the lower receiving channel having a lower centerline, the upper and lower centerlines extending at an gamma angle relative to one another as viewed parallel to the upper surface and perpendicularly to at least one of the upper centerline and the lower centerline, wherein the gamma angle is between 5 and 25 degrees, the upper axis axially aligns with the upper centerline, and the lower axis axially aligns with the bottom centerline.

13. A rebounding device comprising:

a frame member that defines a central opening, a rebounding mat having at least a central portion that is elastically supported by the frame member, that is located within the central opening, and that has an upper surface, a plurality of connectors attached to the central portion at the perimeter of the central portion, at at least one of the plurality of connectors having an upper receiving channel and a lower receiving channel, at least one cordlike flexible elastic member that extends between at least one of the plurality of connectors and the frame member, the at least one cordlike flexible elastic member comprises an upper portion that has an upper axis and that extends from the upper receiving channel to a tangent location at a top of the frame member, the at least one cordlike flexible elastic member comprises a bottom portion that has a lower axis and that extends from the lower receiving channel to a tangent location at a bottom of the frame member, and the upper axis of the upper portion and the lower axis of the lower portion extend at an beta angle relative to one another as viewed parallel to the upper surface and perpendicularly to at least one of the upper and lower axes, and the beta angle is between 5 and 25 degrees, at least one of the plurality of connectors having an upper receiving channel and a lower receiving channel, the upper receiving channel having an upper centerline and the lower receiving channel having a lower centerline, the centerlines extending at an gamma angle relative to one another as viewed parallel to the upper surface and perpendicularly to at least one of the upper centerline and the lower centerline, wherein the gamma angle is between 5 and 25 degrees.

14. The rebounding device according to claim 13 wherein the gamma angle is between 9 and 15 degrees, and the beta angle is between 9 and 15 degrees.

15. The rebounding device according to claim 13 wherein the gamma angle is between 5 and 25 degrees when viewed perpendicularly to the upper axis.

16. The rebounding device according to claim 13 wherein the gamma angle is between 5 and 25 degrees when viewed perpendicularly to the lower axis.

17. The rebounding device according to claim 13 wherein the beta angle is the same as the gamma angle.

18. The rebounding device according to claim 13 wherein the beta angle is between 5 and 25 degrees when viewed perpendicularly to the upper axis.

19. The rebounding device according to claim 13 wherein the beta angle is between 5 and 25 degrees when viewed perpendicularly to the lower axis.

* * * * *